US006077130A

United States Patent [19]

Hughes et al.

[11] Patent Number: 6,077,130

[45] Date of Patent: Jun. 20, 2000

[54] DEVICE-TO-BOARD ELECTRICAL CONNECTOR

[75] Inventors: Madeline Hughes, Powys; Ian Aspland, New Market, both of United Kingdom

[73] Assignee: The Whitaker Corporation, Wilmington, Del.

[21] Appl. No.: 09/250,257

[22] Filed: Feb. 16, 1999

[30] Foreign Application Priority Data

Feb. 27, 1998 [GB] United Kingdom ..... 9804333

[51] Int. Cl.[7] ..... H01R 4/48

[52] U.S. Cl. ..... 439/862; 439/65

[58] Field of Search ..... 439/862, 636, 439/638, 65, 591, 500

[56] References Cited

U.S. PATENT DOCUMENTS

| | | | |
|---|---|---|---|
| 3,858,958 | 1/1975 | Davies | 339/17 LM |
| 3,875,532 | 4/1975 | Kobayashi et al. | 331/94.5 H |
| 4,553,192 | 11/1985 | Babuka et al. | 361/395 |
| 4,664,458 | 5/1987 | Worth | 339/17 M |
| 5,026,290 | 6/1991 | Dery | 439/65 |
| 5,378,160 | 1/1995 | Yumibe et al. | 439/66 |
| 5,479,320 | 12/1995 | Estes et al. | 361/785 |
| 5,551,883 | 9/1996 | Davis | 439/65 |
| 5,746,626 | 5/1998 | Kwiat et al. | 439/630 |

FOREIGN PATENT DOCUMENTS

| | | | |
|---|---|---|---|
| WO 97/45900 | 12/1997 | WIPO | H01R 23/72 |

*Primary Examiner*—Neil Abrams
*Assistant Examiner*—Hae Moon Hyeon
*Attorney, Agent, or Firm*—Driscoll Nina

[57] ABSTRACT

An electrical connector comprises terminals having first, second and third terminal section for connection to a first PCB, battery pack, and second PCB respectively. Each terminal is integrally stamped and formed from sheet metal and the first terminal section is for soldering to the first circuit board whilst the other two terminal sections have spring portions for resiliently abutting respective contact protrusions adjacent the battery pack and second circuit board. Direct electrical connection from the battery pack to both circuit boards provides a compact and reliable power supply to both boards in a cost effective arrangement.

7 Claims, 2 Drawing Sheets

DEVICE-TO-BOARD ELECTRICAL CONNECTOR

BACKGROUND OF THE INVENTION

1. Field of the Invention

This invention relates to an electrical connector for interconnecting a device such as a battery pack to a circuit board.

2. Description of the Prior Art

In international patent application WO/97/45900 a battery connector is disclosed, terminals thereof comprising a printed circuit board connection portion for soldering on a printed circuit board, a contact protrusion projecting beyond a mating face of a connector housing for resiliently biasing against contact pads of a removable battery pack, and a spring portion extending between the contact and printed circuit board connection portions for providing the spring force and flexibility of the contact portion. In electronic devices comprising a plurality of printed circuit boards mounted in a stacked relationship, it is typical to provide a connector mounted on one of the boards, for example by soldering, and having compliant contact portions or even solder portions for connection to a second circuit board mounted in a stacked relationship with respect to the first board, for example as shown in U.S. Pat. No. 5,378,160. It is typical to provide such inter board connectors with terminals that transfer signal and electrical power between the boards. A battery pack or other power source is thus connected to one of the boards, and circuit traces on that board interconnect the power supplied to the first board, to an electrical connector that interconnects the boards.

The arrangement for interconnecting power supply between circuit boards as described above, increases cost and consumes space on the first circuit board due to the requirement for additional circuit traces, which may require a relatively large tracks to supply large currents. It would be desirable to provide a more cost effective and compact arrangement, in particular as concerns interconnection of an external device such as a battery pack to stacked printed circuit boards.

SUMMARY OF THE INVENTION

Objects of this invention have been achieved by providing the connector according to claim 1. Disclosed herein is an electrical connector for interconnecting a device such as a battery pack to at least two stacked printed circuit boards, the connector comprising an insulative housing having cavities, and electrical terminals mounted in the cavities, each terminal comprising a first connection section for secure electrical and mechanical connection to a first printed circuit board, a compliant second connection section having a contact portion resiliently abuttable against a contact pad of a device such as a battery pack, the first and second connection sections integrally formed together, wherein the terminal further comprises a third connection section integrally formed with the first and second connection sections and having a contact portion for connection to a second printed circuit board. Advantageously therefore, an external device such as a battery pack can be directly connected to two circuit boards thereby obviating the need for circuit traces and additional terminals of an additional connector between the circuit boards. Integral stamping and forming of a multi-function terminal further reduces cost and space requirements.

The contact portion for the second circuit board may extend from the first contact portion via a spring arm, and resiliently abut against circuit traces of the second board such that mispositioning of the second board with respect to the first is absorbed. The contact portions of the second and third terminal sections may protrude through faces of the connector housing that are at 90° to each other for a compact arrangement allowing good accessibility of the external device, which may be removably mountable to the circuit board and connector arrangement. The second and third terminal sections may have U-shaped spring sections extending within the cavity housings to allow large elastic travel, whereas the first terminal portion may have pin or solder mount portions for soldering to the first circuit board. Integral forming of the terminals further ensures good electrical connection between the power supply device and both circuit boards.

Further advantageous aspects of this invention are set forth in the claims, or will be apparent from the following description and drawings.

DETAILED DESCRIPTION OF THE PREFERRED EMBODIMENT

Figure 1:
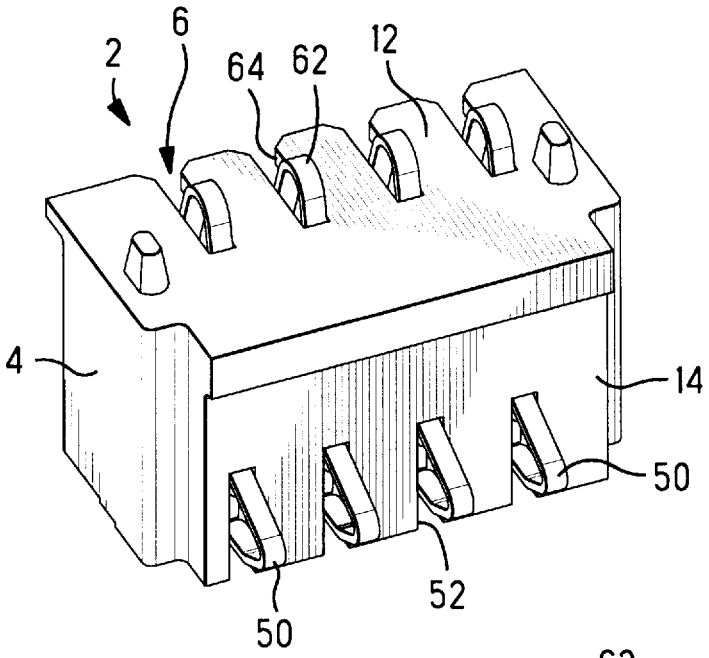
FIG. 1 is an isometric view of a connector according to this invention viewed towards second and third mating faces.
Figure 2:
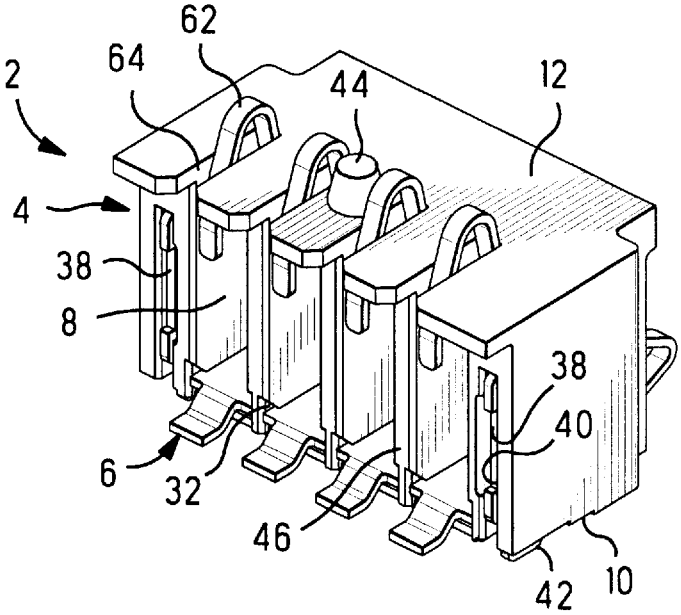
FIG. 2 is an isometric view of the connector viewed towards the third mating face and a terminal receiving face opposed to the second mating face.
Figure 3:
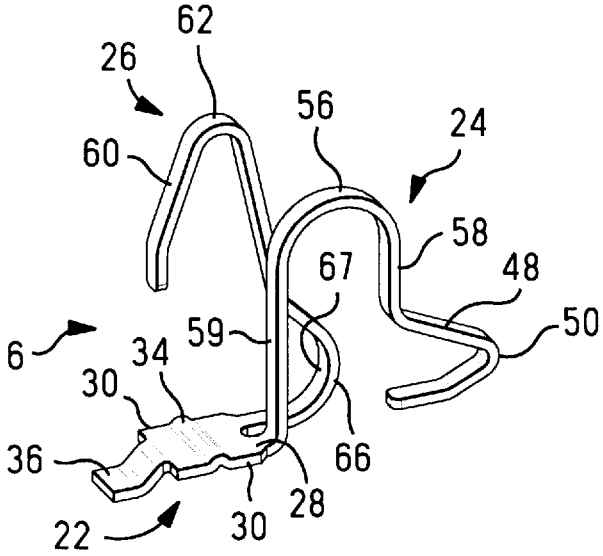
FIG. 3 is an isometric view of a terminal of the connector.
Figure 4:
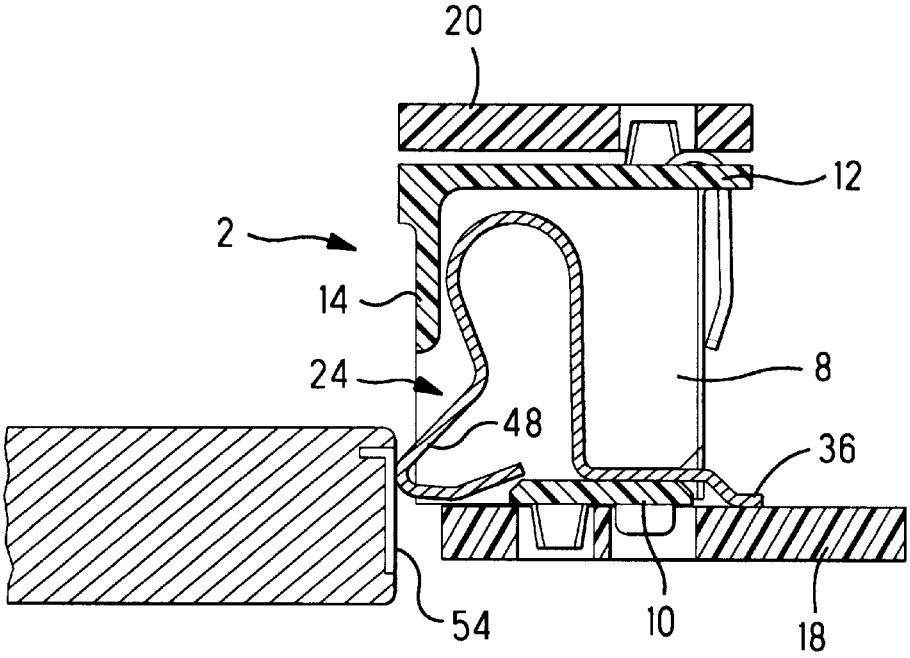
FIG. 4 is a cross sectional view through the connector showing parts of stacked printed circuit boards and a device to be connected to the circuit boards, the cross sectional view taken through a second terminal section of one of the terminals.
Figure 5:
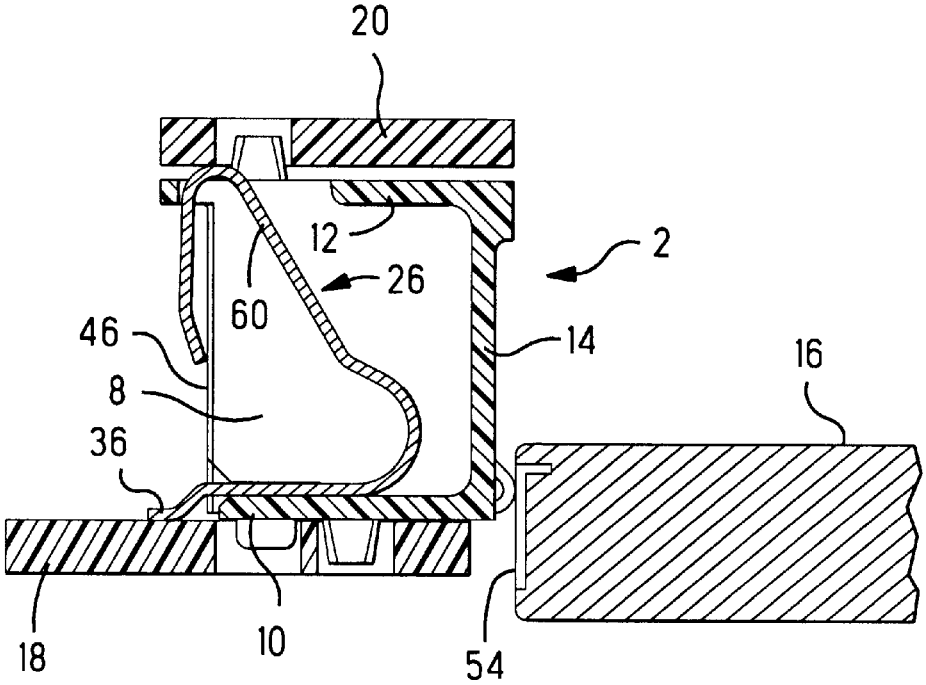
FIG. 5 is a view similar to FIG. 4 but taken through a third terminal section of one of the terminals.

Referring to the figures, an electrical connector 2 comprises an insulative housing 4 having a plurality of terminals 6 mounted in a juxtaposed arrangement in terminal receiving cavities 8 of the housing. The housing 4 has a first PCB mounting or mating face 10 and opposed thereto a third PCB mounting or mating face 12 between which the cavities 8 extend. A second mating face 14 extends between the opposed PCB mounting faces 10, 12 and is for receiving a device such as a battery pack 16 adjacent thereto, that may be removably mountable or pluggable to an assembly comprising first and second printed boards 18, 20.

Each terminal comprises a first connection section 22, a second connection section 24, and a third connection section 26. The first connection section 22 comprises a base 28 having a mounting portion 30 in the form of lateral extensions that engage in mounting slots 32 of the housing proximate the first circuit board mounting face 10, for receiving the extensions 30 in an interference fit. The mounting extensions 30 may be provided with retention barbs (not shown) for digging into the plastic housing for more secure retention. An embossed rib 34 extending between the extensions 30 further stiffens the mounting portion 30. From the mounting portion 30 extends a surface mount tab 36 for solder connection to circuit traces on the first circuit board 18. The solder connection of the terminal surface mount tab 36 also provide a mechanical attachment of the connector to the first board.

Further stamped and formed fixing blades 38 may be provided in cavities 40 and comprise fixing extensions 42 that are soldered to the first circuit board 18 to enhance mechanical attachment thereto. In order to position the connector with respect to the circuit boards 18, 20, each opposed mating face 10, 12 may be provided with positioning studs 44 receivable in corresponding locating holes of the boards.

The terminal receiving cavities 8 extend to a terminal receiving face 46 of the connector opposed to the device mating face 14 such that the terminals 6 can be stitched into the cavities in a single operation by insertion through the terminal receiving face 46, in order to simply manufacturing steps.

The second connection section 24 comprises a contact portion 48 having an arcuate contact protrusion 50 projecting through a slot 52 of the housing beyond the device mating face 14 for resilient abutment against contact pads 54 of the device, which may be removably pluggable thereagainst. Resiliency of the contact portion 48 is provided by a U-shaped spring portion 56 extending between the base 28 of the first contact section 22 and the contact portion 48. Large elastic flexibility of the contact protrusion 50 is provided by the spring arms 58, 59 of the U-shaped spring portion 56, that extend substantially parallel to the device mating face 14.

The third connection section 26 also comprises a contact portion 60 with a contact protrusion 62 extending through a slot 64 of the third circuit board mating face 12 for resiliently biasing against circuit traces on the second circuit board 20. Resiliency of the contact portion 60 is provided by a substantially U-shaped spring portion 66 extending between the contact portion 60 and the base 28 of the first connection section 22. The spring portion 66 is designed to bend mainly in the rounded portion 67 of the U-shape such that the contact protrusion 62 pivots thereabout, in order to effect a wiping action against the circuit board conductive tracks to remove dirt or oxide layers. Resiliency of the third connection section 26 enables a certain absorption of mispositioning between the two circuit boards, particularly in the distance between boards, or to allow a certain floatability of the boards 18, 20 with respect to each other.

The terminal 6 is stamped and formed from sheet metal as an integral part for particularly cost effective manufacturing. The integral terminals and direct connection between the device, which may be a power supply, and both circuit boards 18, 20 simultaneously also enables reliable supply of high electrical currents to the circuit boards in a simple and compact manner. The slots 52, 64 receiving the contact protrusions 50, 62 respectively assist in laterally guiding and supporting the second and third contact sections 24, 26 respectively whilst enabling the terminals to be mounted in a single insertion movement into their cavities 8 during manufacturing. By stamping and forming the plurality of terminals 6, in a juxtaposed arrangement extending from a single carrier strip, the terminals 6 can be mounted simultaneously into the connector cavities 8 and cut away from the carrier strip.

We claim:

1. An electrical connector for interconnecting a device such as a battery pack to at least two stacked printed circuit boards, the connector comprising: an insulative housing having cavities and electrical terminals mounted in the cavities, each terminal comprising a first connection section for secure electrical and mechanical connection to a fist printed circuit board, a compliant second connection section having a contact portion resiliently abuttable against a contact pad of the device, the first and second connection sections integrally formed together, wherein the terminal further comprises a third connection section integrally formed with the first and second connection section and having a contact portion for connection to a second printed circuit board where the contact portion of the third connection section is resiliently attached to the first connection section via a supple spring portion extending therebetween.

2. The connector of claim 1 wherein the second and third contact portions extend through mating faces of the respect to each other.

3. The connector of claims 1 wherein the housing cavities extend into the housing from a terminal receiving face such that the terminals can be inserted into the housing in a single stitching action.

4. The connector of claim 3 wherein the mating faces for receiving the device and second PCB respectively thereagainst are provided with slots receiving therethrough contact protrusions of the second and third connection section respectively, whereby the slots are arranged to enable insertion of the terminals into the cavities in a single action through the terminal receiving face.

5. The connector of claim 3 wherein the terminal receiving face is opposed to the device mating face.

6. The connector of claim 1 wherein the second and third connection sections of each terminal are arranged substantially parallel and adjacent each other extending from a base of the first connection section.

7. The connector of claim 1 wherein the first connection section comprises a circuit board attachment portion for solder attachment to the first circuit board.

* * * * *